United States Patent [19]

Rotzler

[11] 4,276,823

[45] Jul. 7, 1981

[54] ECCENTRIC PRESS

[75] Inventor: Frank Rotzler, Oetisheim, Fed. Rep. of Germany

[73] Assignee: R W M-Raster-Werkzeugmaschinen GmbH, Oetisheim, Fed. Rep. of Germany

[21] Appl. No.: 107,583

[22] Filed: Dec. 27, 1979

[30] Foreign Application Priority Data

Jan. 11, 1979 [DE] Fed. Rep. of Germany ..... 2900900
Jan. 11, 1979 [DE] Fed. Rep. of Germany ..... 2900901

[51] Int. Cl.[3] ..... B30B 1/06

[52] U.S. Cl. ..... 100/257; 100/282; 74/40

[58] Field of Search ..... 100/257, 282, 283, 285, 100/291, 292; 74/38, 40, 586; 83/525, 527

[56] References Cited

U.S. PATENT DOCUMENTS

| | | | |
|---|---|---|---|
| 2,085,648 | 6/1937 | Glasner | 100/285 |
| 3,373,596 | 3/1968 | Moeller | 100/257 |
| 4,160,409 | 7/1979 | Portmann | 100/257 |

FOREIGN PATENT DOCUMENTS

| | | | |
|---|---|---|---|
| 792529 | 3/1960 | France | 100/282 |
| 1723 | of 1880 | United Kingdom | 100/257 |
| 626980 | 8/1978 | U.S.S.R. | 100/283 |

*Primary Examiner*—Billy J. Wilhite
*Attorney, Agent, or Firm*—Balogh, Osann, Kramer, Dvorak, Genova & Traub

[57] ABSTRACT

An eccentric shaft is rotatably mounted in a frame, in which a ram is vertically and slidably mounted. First and second connecting rods are provided, each of which has an inner end rotatably mounted on the eccentric shaft. The first and second connecting rods are arranged to perform mutually opposing motions in response to a rotation of said eccentric shaft. The frame carries first and second slot-defining members, which are disposed on opposite sides of the eccentric shaft and define first and second guide slots, respectively. The latter are horizontally aligned and arranged to guide the outer ends of the first and second connecting rod means, respectively. In addition, first and second ball crank levers are disposed on opposite sides of the eccentric shaft and pivoted to the ram. The first and second bell crank levers have first and second output arms, respectively, which are operatively connected to the ram, and first and second guide arms, respectively, which extend at an angle to said output arm. The guide arms are formed with substantially vertical first and second guide slot members, respectively, which are arranged at the outer ends of the first and second connecting rods, respectively.

15 Claims, 10 Drawing Figures

ECCENTRIC PRESS

Figure 1:
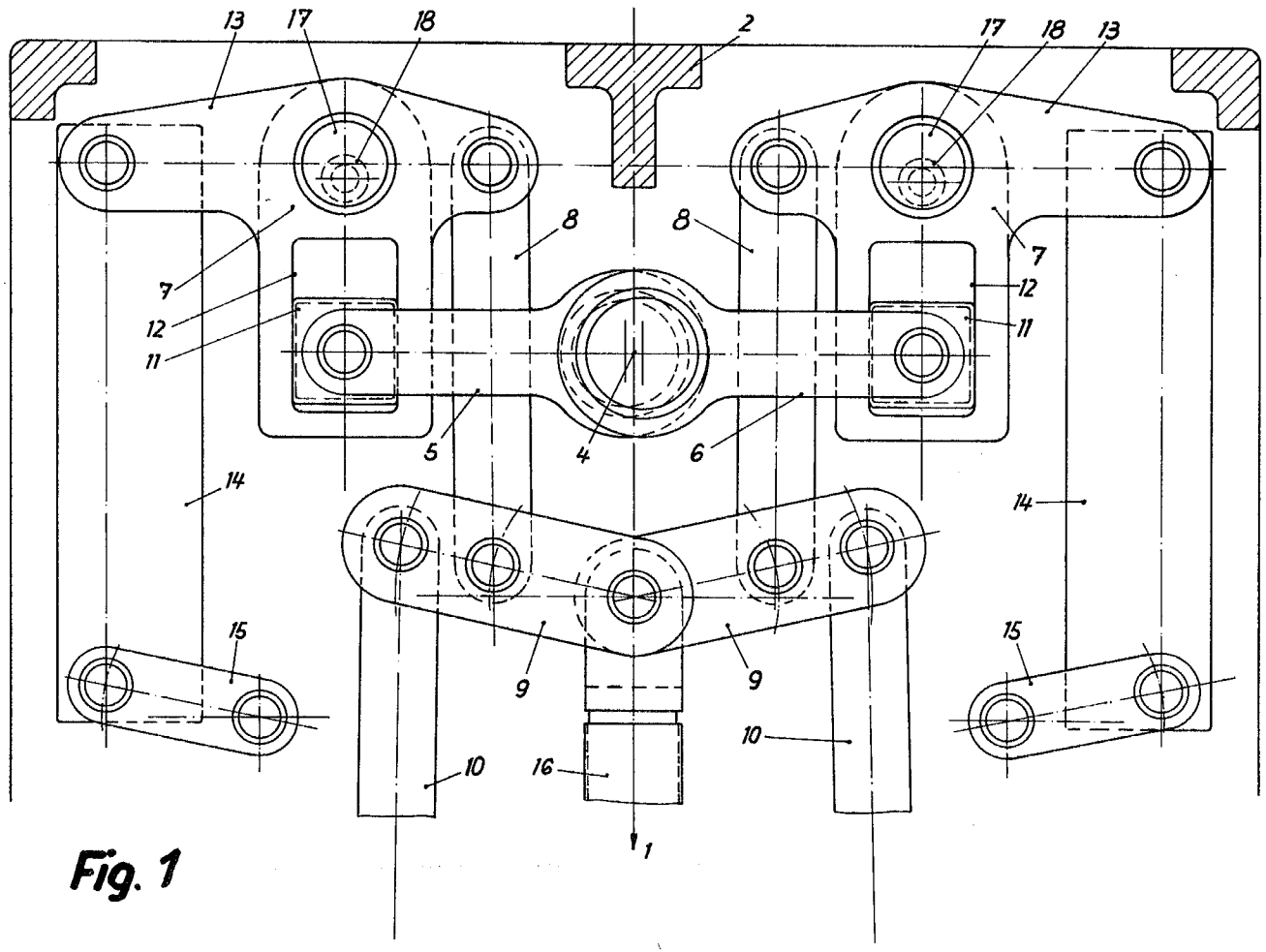

This invention relates to an eccentric press for pressing and punching work, in which the ram is actuated by connecting rods mounted on an eccentric shaft.

In the conventional eccentric presses for pressing and punching work in which the ram is actuated by connecting rods driven by an eccentric shaft, the connecting rods are moved downwardly or outwardly and are connected to the ram rod by levers so that the eccentric shaft is substantially deflected and its bearings are subjected to heavy loads.

In eccentric presses for pressing or punching work, in which the ram is driven by connecting rods from an eccentric shaft, it is an object of the invention to avoid a deflection of the eccentric shaft as far as possible and to reduce the load on the main bearings in the press frame, also to ensure that the ram will be lifted quickly and that its stroke can be adjusted so that high-duty, high-speed presses can be operated with short strokes.

In an eccentric press for pressing or punching work in which the ram is actuated by connecting rods mounted on an eccentric shaft, this object is accomplished in that the connecting rods act outwardly and are driven by eccentric sheaves on the shaft and are connected to the ram by bell crank levers, and oppositely moving connecting rods are disposed in a common plane and at their free ends are horizontally guided in guide slots and are vertically guided in the vertical arm of the associated bell crank lever during its pivotal movement.

This arrangement results in a high-duty high-speed press in which the eccentric shaft and its main bearings are relieved from the load due to the blow of the press because the connecting rods disposed in a common plane perform exactly opposite motion. The rotating masses are also balanced. The bell crank levers redirect the ram-actuating force from a horizontal to a vertical direction. A definite geometry is established throughout the sequence of motions. This is essential for the accuracy of the pressing or cutting operations performed by such high-speed presses. The high speed is also promoted by the use of small eccentric sheaves on the main shaft. The motion imparted by said eccentric sheaves is increased by the special linkage connecting the sheaves to the ram.

Where T-shaped beel crank levers are used, the horizontal crosspieces thereof may be connected at one end to the ram by a vertical push rod and may be provided at the other end with a counterweight for balancing the weight of the ram.

Each push-rod acts on the ram rod by means of a rocker lever, which is adjustable to change the ram position by a screw acting on the rocker lever at one end thereof and is pivoted to the ram rod at the other end whereas the push rods are connected to intermediate portions of the rocker levers.

According to a further feature of the invention the pivot pins for the bell crank levers comprise eccentric sheaves for quickly lifting the ram and the eccentric pivot pins for the bell crank levers are adjustable by means of a rack-and-pinion drive and are provided with cam means which cooperate with cam followers to define an end position.

The pivot pins for the bell crank levers may be adjustable in vertical slots by positively synchronized mounting screws.

If pairs of oppositely moving connecting rods are provided, one pair of such connecting rods may act on ram rods by means of bell crank levers and push rods or two pairs of connecting rods may act on ram rods by means of bell crank levers and push rods. In the former case, a central connecting rod is provided as well as two outer connecting rods for a motion which opposes that of the central connecting rod, and in the second case adjacent connecting rods perform opposing motions.

Figure 3:
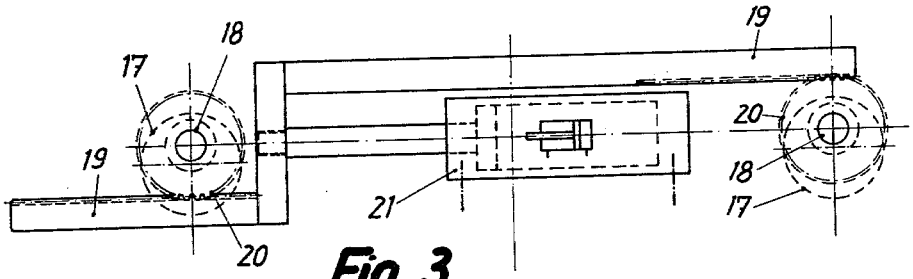
Figure 2:
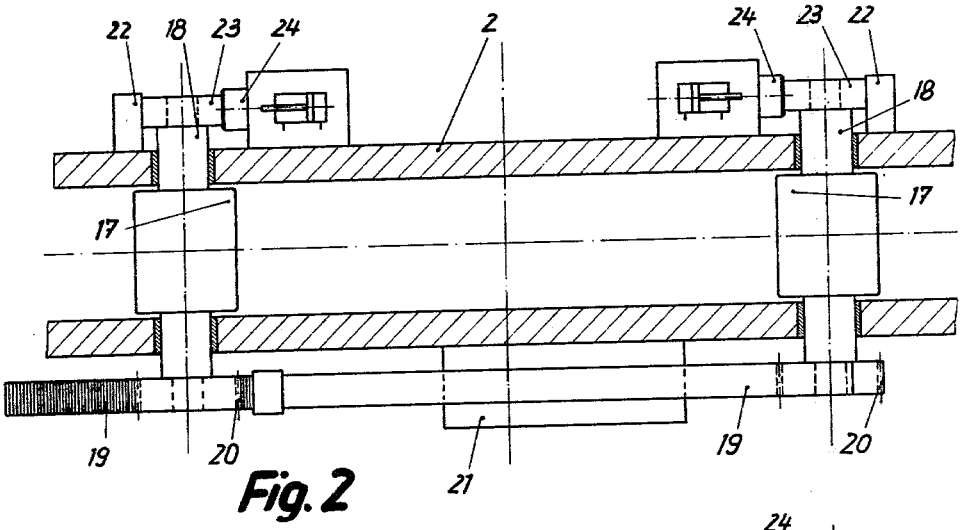
Figure 4:
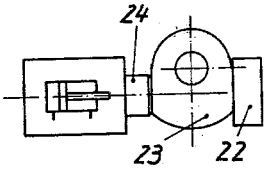
Figure 6:
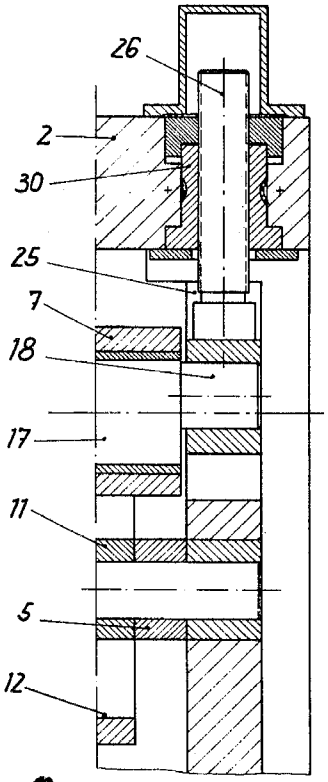
Figure 5:
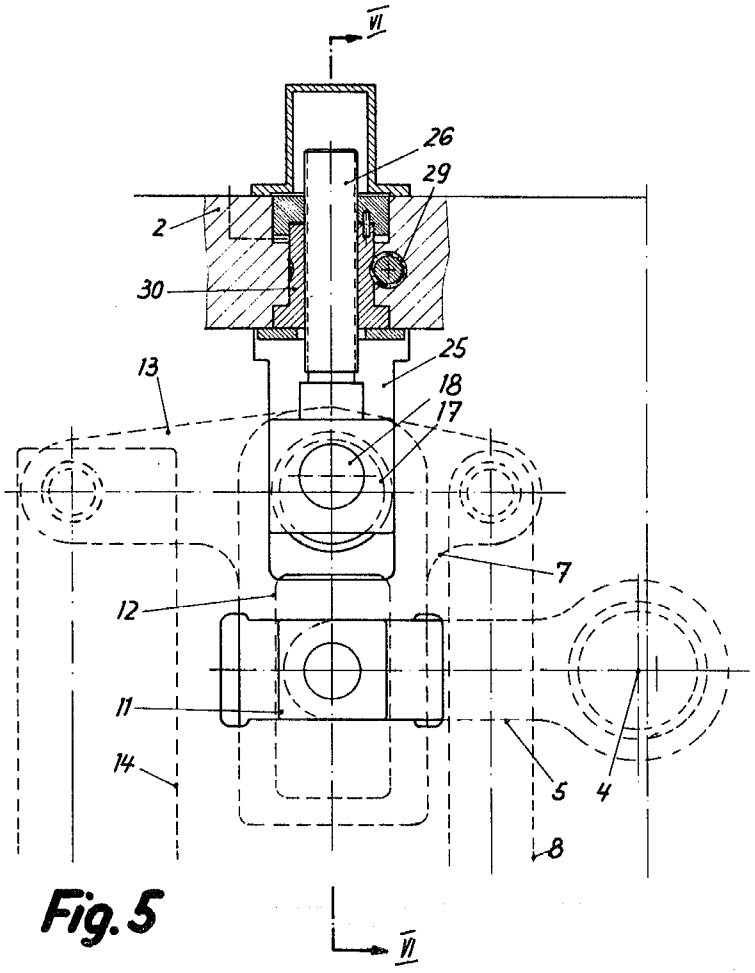
Figure 7:
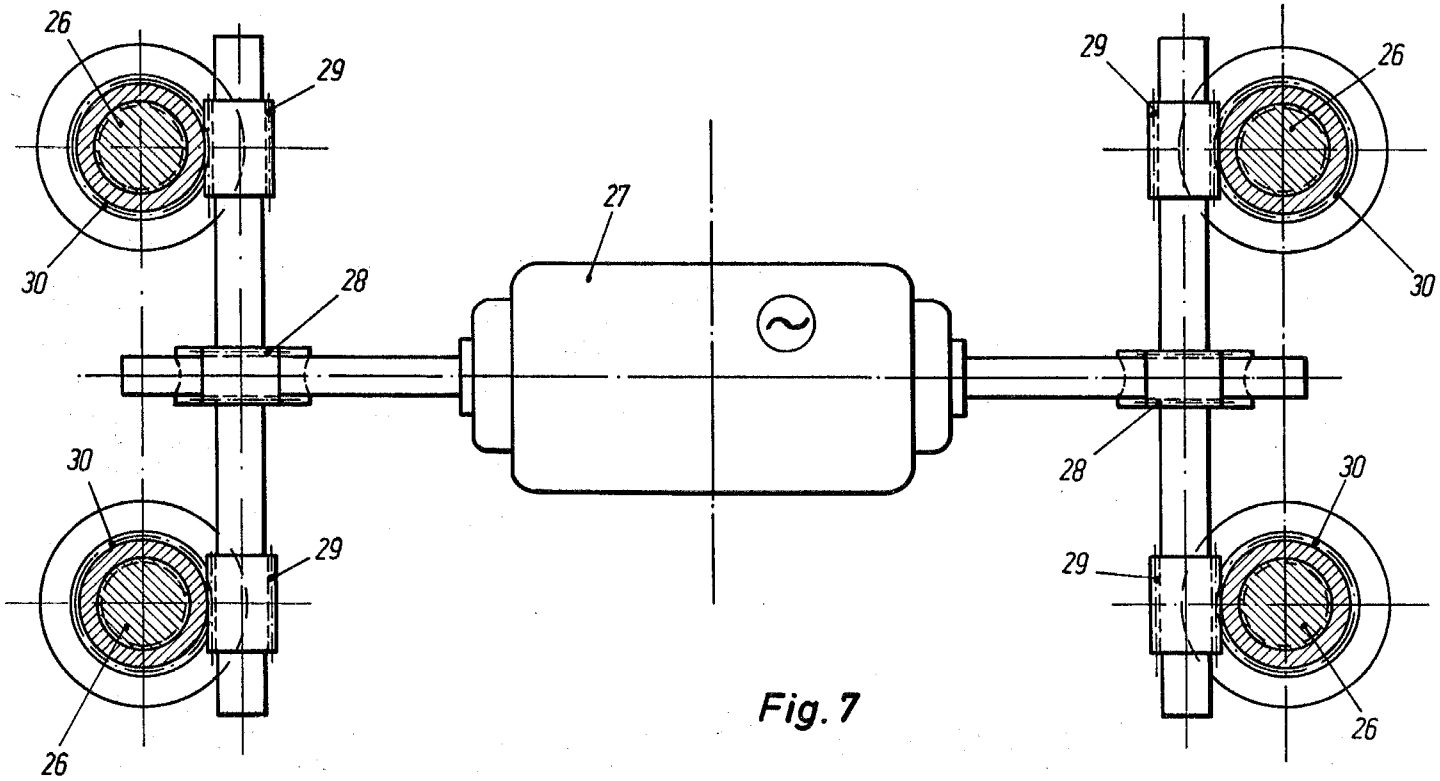
Figure 9:
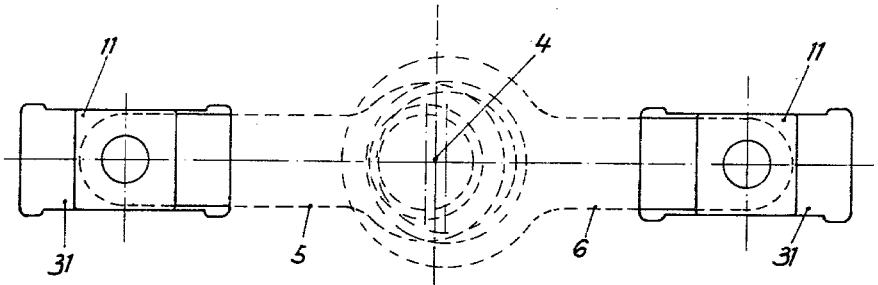
Figure 8:
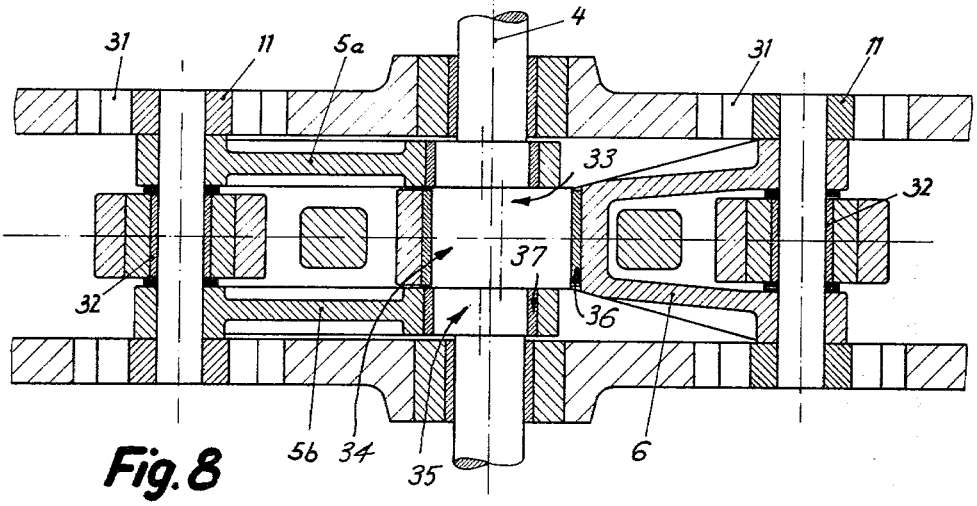
Figure 10:
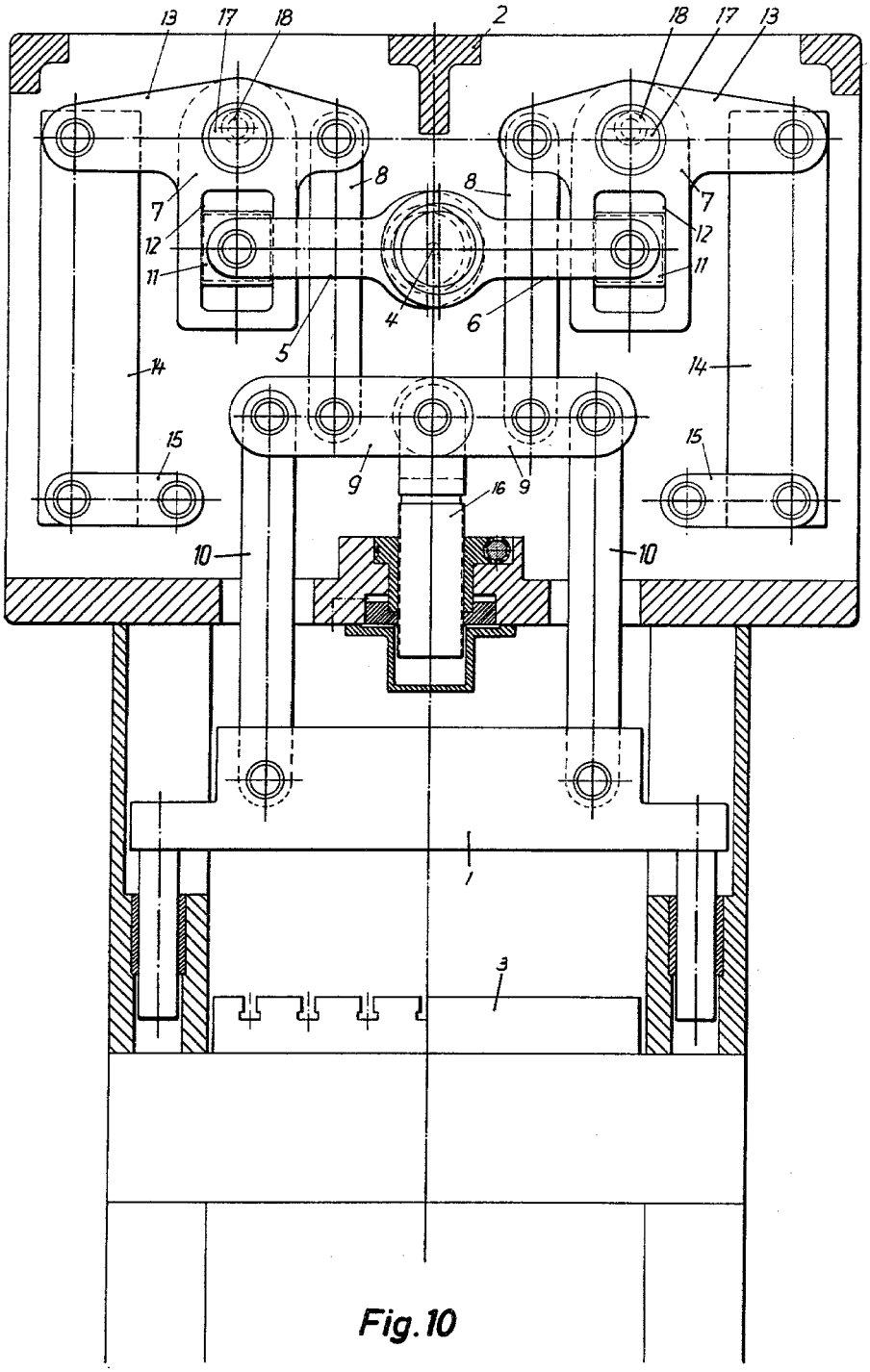

A preferred embodiment of an eccentric press for pressing or punching work, which embodies the invention and in which the ram is operated by connecting rods mounted on an eccentric shaft, will now be described by way of example with reference to the accompanying drawings, in which FIG. 1 is a fragmentary elevation showing a portion of the eccentric shaft with a connecting rod and a bell crank lever for driving the ram, FIGS. 2 to 4 are a top plan view, a side elevation and a detail view showing the means for quickly lifting the ram, FIGS. 5 to 7 are elevations and a sectional view showing the means for adjusting the stroke of the ram, FIGS. 8 and 9 are, respectively, a top plan view and a side elevation showing the eccentric shaft and the connecting rods, and FIG. 10 is an overall view showing the means for driving the ram.

From the fragmentary elevation shown in FIG. 1 and considered in conjunction with the overall view of FIG. 10, the ram 1 is mounted in a frame 2, which comprises a work table 3. The ram 1 is driven by the eccentric shaft 4 by means of oppositely moving, horizontal connecting rods 5 and 6 and by bell crank levers 7, which are connected by push rods 8 to the rocker levers 9. The latter are connected to the ram rods 10. Each connecting rod 5 or 6 is provided at its outer end with a slider 11, which is guided in a horizontal guide slot formed in the frame 2 and in a substantially vertical guide slot 12 formed in the vertical arm of the bell crank lever 7. In this embodiment each bell crank lever 7 is T-shaped and its cross-piece 13 is connected at one end to the ram 1 by a vertical push rod 8 so that the force is redirected by the lever 7. Because the connecting rods 5 and 6 perform mutually opposing motions and so do the counterweights 14, which are constrained by links 15, the machine frame 2 is relieved from bending forces and vibrations are avoided.

In accordance with FIGS. 1 and 10, the push rods 8 are connected to the ram rods 10 and the ram 1 by rocker levers 9, which effect a speed-increasing or speed-decreasing transmission. Each rocker lever 9 is adjustable by means of a screw 16, which engages the rocker lever 9 at one end thereof and serves to adjust the position of the ram. At its other end, the rocker lever 9 is pivoted to the associated ram rod 10. The push rod 8 is pivoted to an intermediate portion of the rocker lever 9. The height of the ram above the work table 3 can thus be adjusted by the adjusting screw 16.

For a rapid lifting of the ram 1, the pivot pins 17 of the bell crank levers 7 are provided with eccentric sheaves 18. The eccentric pivot pin 17 for each bell crank lever 7 is rotatable by means of a pinion 20, which is non-rotatably mounted on one end of the pivot pin 17 and meshes with a rack 19. The latter is actuated by a hydraulic cylinder 21, see FIGS. 2 and 3. A camwheel 23 is non-rotatably mounted on the other end of each pivot pin 17 and cooperates with a cam follower 22, which defines an end position, in which the camwheel 23 is adapted to be releasably clamped by a hydraulically actuated plunger 24, as is shown in FIG. 4.

In accordance with FIGS. 5 and 6, the pivot pins 17 for the bell crank levers 7 are guided in vertical longitudinal slots 25 and are vertically adjustable by mounting screws 25 to adjust the stroke of the ram 1. In accordance with FIG. 7, a common adjusting motor 27 is provided, which drives worms in mesh with worm wheels 28, which are non-rotatably connected to worms 29 in mesh with worm wheel sleeves 30 non-rotatably connected to the mounting screws 26 so that their movements will be positively synchronized.

The leverage provided by the bell crank lever 7 can be infinitely adjusted to change of the stroke of the ram. For this purpose the slot-defining means formed with the horizontal guide slots 31 for the sliders 11 are vertically adjustable. The sliders 11 are slidably guided in the vertical guide slots of the associated bell crank lever 7.

FIG. 8 shows also a center bearing 32.

Where one pair of connecting rods 5 and 6 are provided, which are connected to ram rods 10 by bell crank levers 7 and push rods 8, it is desirable to provide in accordance with FIGS. 8 and 9 a central connecting rod 6 and two outer connecting rods 5*a* and 5*b*, which perform motions that are opposed to that of the central connecting rod 6, so that a deflection of the eccentric shaft 4 will be avoided. Where two pairs of connecting rods 5 and 6 are provided, which are connected to ram rods 10 by means of bell crank levers 7 and push rods 8, the motions of adjacent connecting rods suitably oppose each other, (this is not shown on the drawings).

In addition, FIG. 8 illustrates the cam 33 mounted on the eccentric shaft 4. Cam 33 has a central portion 34, the central axis of which coincides with the central axis of frame 2 and ram 1, and an eccentric body portion 35, the central axis of which is offset from those of both eccentric shaft 4 and central portion 34.

The central connecting rods 6 and the outer connecting rods 5*a* and 5*b* cooperate with cam portions 34 and 35, respectively, by means of cam followers 36 and 37 mounted on the latter, respectively.

It is apparent that the means provided according to the invention for driving the press provide a balanced transmission of force from the eccentric shaft to the ram along a plurality of paths and permit an adjustment of the stroke by a screw, as has been described. Because the connecting rods perform motually opposing motions, a deflection of the eccentric shaft will be avoided and the main bearings in the frame of the press will be relieved. As the vertical adjusting movements of the pivot pins for the bell crank levers are synchronized, the stroke of the ram can be infinitely adjusted by a change of the lever ratio. The rapid lifting of the ram permits extremely small strokes, as is essential for high-speed presses. The press according to the invention can be very conveniently controlled.

What is claimed is:

1. An eccentric press comprising a frame, an eccentric shaft rotatably mounted in said frame, a ram vertically slidably mounted in said frame, first and second connecting rod means, each of which has an inner end rotatably mounted on said eccentric shaft and an outer end, said first and second connecting rod means being arranged to perform mutually opposing motions in response to a rotation of said eccentric shaft, first and second slot-defining means carried by said frame and disposed on opposite sides of said eccentric shaft and defining first and second horizontal guide slots, respectively, which are horizontally aligned and arranged to guide said outer ends of said first and second connecting rod means, respectively, first and second ball crank lever means disposed on opposite sides of said eccentric shaft and pivoted to said frame, first and second bell crank lever means having first and second output arm means, respectively, which are operatively connected to said ram, and first and second guide arm means, respectively, which extend at an angle to said output arm means and are formed with substantially vertical first and second guide slot means, respectively, which are arranged to guide said outer ends of said first and second connecting rod means, respectively.

2. An eccentric press as set forth in claim 1, in which said bell crank lever means are T-shaped and comprise crosspiece means which constitute said output arm means, first and second push rod means are provided, which are operatively connected to said ram and to one end of said crosspiece means of said first and second bell crank lever means, respectively, and first and second counterweight means are connected to said first and second bell crank lever means at the other end of said crosspiece means thereof.

3. An eccentric press as set forth in claim 2, in which said ram is rigid with first and second ram rod means disposed on opposite sides of said eccentric shaft and on top of said ram, each of said first and second push rod means are connected to said first and second ram rod means, respectively, by first and second rocker lever means, respectively, which at one end are pivoted to the associated ram rod means, said first and second ram rod means are pivoted to first and second rocker lever means, respectively, at one end thereof, first and second adjusting screw means are operatively connected to said first and second rocker lever means, respectively, and operable to adjust the position of said ram, and said first and second push rod means are pivoted to said rocker lever means between said ends thereof.

4. An eccentric press as set forth in claim 1, in which said first and second bell crank lever means are pivoted to said frame by eccentric pivot pins, which are rotatable to move said ram.

5. An eccentric press as set forth in claim 4, in which a rack-and-pinion drive is operatively connected to each of said pivot pins at one end thereof and operable to rotate said pivot pin, cam means are rotatably connected to each of said pivot pins at the other end thereof, and cam follower means are provided, which cooperate with said cam means to define an end position of said ram.

6. An eccentric press as set forth in claim 5, which comprises hydraulically actuated plungers for releasably clamping said cam means against said cam followers.

7. An eccentric press as set forth in claim 1, in which said frame is formed with first and second pairs of transversely spaced apart vertical slots, said first and second bell crank lever means are pivoted to said frame by means of first and second pivot pins, respectively, which are slidably mounted in said first and second pairs of slots, respectively, and adjusting means are provided for adjusting said pivot pins along said pairs of slots.

8. An eccentric press as set forth in claim 7, in which said pivot pins are eccentric and rotatable to move said ram.

9. An eccentric press as set forth in claim 7, in which said adjusting means comprise mounting screws in which said pivot pins are rotatably mounted and drive means for positively rotating said mounting screws in unison.

10. An eccentric press as set forth in claim 1, which comprises means for infinitely adjusting the lever ratio of said bell crank lever means so as to change the stroke of said ram.

11. An eccentric press as set forth in claim 10, in which said slot-defining means are vertically adjustable to positions which include a position in which said horizontal guide slot means are substantially horizontally aligned with said eccentric shaft.

12. An eccentric press as set forth in claim 1, in which said first connecting rod means comprise two connecting rods, which are rotatably mounted on axially spaced apart portions of said eccentric shaft, and said second connecting rod means comprise a connecting rod which is rotatably mounted on said eccentric shaft between said axially spaced apart portions.

13. An eccentric press as set forth in claim 1, in which each of said first and second connecting rod means comprise two connecting rods, which are rotatably mounted on axially spaced apart portions of said shaft, and one connecting rod of each of said first and second connecting rod means is rotatably mounted on said eccentric shaft on a portion thereof which is disposed between the portions of said shaft on which the connecting rods of the other of said first and second connecting rod means are rotatably mounted.

14. An eccentric press as set forth in claim 1, in which said ram is arranged to perform a working stroke in response to outwardly directed movements of said first and second connecting rod means relative to said eccentric shaft.

15. An eccentric press as set forth in claim 1, in which said horizontal guide slot means are substantially horizontally aligned with said eccentric shaft.

* * * * *